US011377762B2

(12) United States Patent
Johanson

(10) Patent No.: US 11,377,762 B2
(45) Date of Patent: Jul. 5, 2022

(54) WOVEN FABRIC COMPOSED OF TAPE-LIKE WARPS AND WEFTS

(71) Applicant: TAPE WEAVING SWEDEN AB, Borås (SE)

(72) Inventor: Mats Johanson, Fristad (SE)

(73) Assignee: TAPE WEAVING SWEDEN AB, Boras (SE)

( * ) Notice: Subject to any disclaimer, the term of this patent is extended or adjusted under 35 U.S.C. 154(b) by 589 days.

(21) Appl. No.: 15/574,407

(22) PCT Filed: May 19, 2016

(86) PCT No.: PCT/EP2016/061258
§ 371 (c)(1),
(2) Date: Nov. 15, 2017

(87) PCT Pub. No.: WO2016/184960
PCT Pub. Date: Nov. 24, 2016

(65) Prior Publication Data

US 2018/0135212 A1 May 17, 2018

(30) Foreign Application Priority Data

May 20, 2015 (EP) ..... 15168471

(51) Int. Cl.
*D03D 11/00* (2006.01)
*D03D 15/00* (2021.01)
(Continued)

(52) U.S. Cl.
CPC ..... *D03D 11/00* (2013.01); *D03D 13/00* (2013.01); *D03D 13/004* (2013.01); *D03D 15/46* (2021.01); *D03D 49/70* (2013.01)

(58) Field of Classification Search
None
See application file for complete search history.

(56) References Cited

U.S. PATENT DOCUMENTS

2005/0239354 A1 10/2005 Dufresne-Nappert et al.
2007/0277897 A1 12/2007 King
2011/0240168 A1 10/2011 Shahkarami

FOREIGN PATENT DOCUMENTS

WO WO 2005/086689 A1 9/2005
WO WO 2007/139593 A1 12/2007
WO WO 2011/038510 A1 4/2011

OTHER PUBLICATIONS

International Search Report (PCT/ISA/210) dated Aug. 23, 2016, by the Japanese Patent Office as the International Searching Authority for International Application No. PCT/EP2016/061258.
(Continued)

*Primary Examiner* — Shawn Mckinnon
(74) *Attorney, Agent, or Firm* — Buchanan Ingersoll & Rooney P.C.

(57) ABSTRACT

A novel woven fabric is provided wherein preferably two unidirectional mutually offset and at least partly overlapping layers of tape-like warps interlace with tape-like wefts, at least some being fibrous tapes, that are incorporated individually in either non-overlapping manner or in a mutually offset and overlapping manner relative to other weft tapes. Such a woven fabric is without see-through gaps at the areas/sites encircled by intersecting tape-like warps and wefts, and also delamination resistant. It is particularly suitable for composite material, ballistic mitigation, and similar applications.

20 Claims, 3 Drawing Sheets

(51) Int. Cl.

| | |
|---|---|
| ***D03D 49/70*** | (2006.01) |
| ***D03D 13/00*** | (2006.01) |
| ***D03D 15/46*** | (2021.01) |

(56) References Cited

OTHER PUBLICATIONS

Written Opinion (PCT/ISA/237) dated Aug. 23, 2016, by the Japanese Patent Office as the International Searching Authority for International Application No. PCT/EP2016/061258.

WOVEN FABRIC COMPOSED OF TAPE-LIKE WARPS AND WEFTS

TECHNICAL FIELD

The present invention relates in general to the field of textiles. In particular, it concerns a woven fabric composed of tape-like warps and wefts, at least some of which are fibrous tapes.

BACKGROUND

Varieties of layered woven fabrics have been developed for over a century and are well known in the field. They have been developed for use in many technical applications such as paper clothing, conveyor belting, injury mitigation, composite reinforcement, filters etc. Within the layered category of woven fabrics, there are products in which two layers of separate woven fabrics are connected without distance between them and there are also products like "double cloth" wherein two separate woven fabrics are joined distantly by yarns, which when cut, results in velvet, carpet etc. There are still other products, like single-piece or stitch-less airbag, which are also produced by weaving simultaneously two separate fabric layers and joining them at the defined edges/seams of the required shape. Sometimes, the separated woven fabric layers of such air-bag products are also connected in a way to restrict the separation distance between the layers within specified limit. However, all these layered woven fabrics are produced using yarns or rovings or tows etc., but not tapes.

Woven materials using solid, non-fibrous tapes are very different from woven materials made of, or comprising, fibrous tapes both in terms of properties, use and manufacturing. Woven materials of such solid tapes that are layered can be exemplified by WO2005/086689 and WO2011/038510. These woven products are made using overlapping solid thermoplastic tapes. These products are directed towards blocking light. These products are neither devised nor suitable for use in composite materials' application.

Further, WO2007/139593 concerns a woven material, comprising warps and wefts which are 'yarns-arranged-in-tape-form', wherein the produced individual upper woven fabric and individual lower woven fabric are connected superposed to each other using additional plurality of securing warp yarns that interlace with the tape-like wefts of the upper and lower fabrics. This is designed for ballistic protection application. Such a product is also neither devised nor suitable for use in composite materials' application.

A relatively recent fabric advancement is in the area of textile reinforcements for composite materials. It concerns development of woven Spread Tow Fabric. Such a fabric is produced using fibrous tapes, instead of yarns/tows/rovings. The required fibrous tapes can be produced by spreading the constituent filaments of, for example, carbon fibre tow/roving. Such Spread Tow Tapes, which typically have all, or almost all of the constituent carbon fibres/filaments oriented in the tape's longitudinal direction, and hence called unidirectional tape or UD tape, are comparatively thinner and wider than the parent flat tow/roving and thereby they also have relatively lower areal weight in comparison to that of the parent flat tow/roving. Another type of "spread" fibrous tape, if it may be called so, can be, for example the strips/bands cut from a non-woven sheet of short fibres wherein the short fibres are not aligned unidirectionally but pointing in all directions randomly, and they are held by inherent fibre-to-fibre friction or mechanical interlocking of fibres or fusion or adhesive or veil/s which adhere to one or both the faces, or a suitable combination of some of these. However, the thin/flimsy/delicate/fragile nature of the UD Spread Tow Tapes requires considerable care in handling and processing. To overcome this practical issue, they are stabilized, at least partly, using suitable binder that could be for example of thermoplastic or thermoset or their combination types or other chemical formulations, which while preventing the constituent fibres/filaments of the Spread Tow Tapes from separating/disintegrating easily, maintain the pliability of the fibrous tape. Fully stabilized fibrous tapes, in comparison to partially stabilized tapes, have their fibres/filaments embedded in the binder/matrix whereby they are relatively less flexible/pliable. Non-stabilized tapes do not have any binder and its filaments are connected by way of inter-fibre migration, frictional forces and cohesion resulting from applied sizing. Application of sizing should not be confused with application of stabilizing agent and binder or binding agent as their purposes are different. Size or sizing agent imparts ease of handling fibres, damage prevention, and enhancing/promoting adhesion of fibres with stabilizing agent and binder or binding agent. Non-stabilized tapes are hence relatively more fragile than partially and fully stabilized tapes. For practical reason a tape is considered here to represent a material the thickness of which is substantially lower than its width and the width is substantially lower than its length.

Fibrous tapes of all kinds, including Spread Tow Tapes, when used as warps and wefts for weaving, present completely new challenges in comparison to use of traditional yarns/tows/rovings and even non-fibrous solid tapes (e.g. thermoplastic), apart from their thin and flimsy nature. A common defect in such tape-woven fabrics, whether produced using partially or fully stabilized fibrous tapes, or non-stabilized fibrous tapes, and even any other type of non-fibrous tapes, is the inherent openings/gaps occurring in the areas/sites encircled by intersecting tape-like warps and wefts. No matter how well and closely the tape-like warps and wefts are arranged in the tape-woven fabric, such gaps/openings are a natural attribute as a result of their interlacing and cannot be avoided. Such gaps/openings tend to be relatively larger and more prominent with use of relatively thicker tapes of any type.

While tape-woven fabrics with pinhole/small gaps/openings do not adversely affect the looks of the tape-woven fabric, and for that matter even that of the composite material comprising such reinforcement, it is the relatively large see-through gaps that impair the looks and even material performance to a significant degree/level, for example in ballistic mitigation and air-bag applications. Of course this problem gets somewhat mitigated by plying/stacking, for example, two similar tape-woven fabrics in a slightly mutually offset manner so that the gaps/openings in one fabric are hidden/covered by the interlacing tapes of the other tape-woven fabric. When tape-woven fabrics of dissimilar tape widths are plied/stacked, even without being relatively offset, then the see-through gaps in them might get mutually covered to some extent as some of the interlacing areas of tape-like warps and wefts of one fabric will lie over the gaps of the other fabric.

However, these plied/stacked sheets of tape-woven fabrics remain separated/disconnected from each other. They are thus liable to separation/delamination. Further, such plying of tape-woven fabrics involves an extra production step and requires certain skills and care, making the manufacture relatively slow and expensive. It is practically unrealizable to reduce gaps/openings in a tape-woven fabric by supplying warp tapes in a manner that the adjacent longitudinal edges of two tapes are always in contact, and the weft tapes are packed closely to each other to also have their longitudinal edges in contact with each other.

From composite materials' application point of view, it is imperative that the crimp, measurable as crimp frequency and/or crimp angle, in a tape-woven material, due to unavoidable interlacing of warp and weft tapes, is as low as possible to maximize the mechanical properties of the high-performing fibres that are used. While crimp frequency and crimp angle could be kept extremely low with use of very thin and wide warp and weft tapes, the resulting tape-woven material would also tend to be correspondingly thinner. This would necessitate plying/stacking several such thin tape-woven materials to reach a certain thickness for a given performance value. However, as the number of plies/stacks of tape-woven increases, there is also the corresponding increase in delamination risk. On the other hand, using thicker tapes would not only create relatively large angled crimps but also relatively undesirable large spaces between the tapes of the warp and weft directions.

There is therefore a need for a new type of a 'layered' woven material that solves, or at least alleviates the above-mentioned problems. In particular, there is a need for a woven material made of fibrous tapes with reduced problems of gaps or openings in the fabric, and which has increased stability and resistance against delamination besides extremely low crimp frequency and/or crimp angle, and/or which is easier and less costly to produce. Such material is considered to be useful in applications such as composite material, ballistic mitigation, etc.

SUMMARY

An objective of the present invention is to provide a woven fabric, as well as a method and apparatus for its production, which alleviate at least some, and preferably all, of the above-discussed problems. In particular, a further objective is to provide a layered woven fabric comprising partly overlapping fibrous tape-like warps and/or wefts wherein there is increased stability and resistance against separation and delamination, there is relatively less crimp, and in particular less crimp frequency and/or crimp angle, which advantageously creates flatter fabric surface, and/or where the see-through gaps or openings in the fabric are alleviated or eliminated. Further, it is an object of the present invention to provide a method and apparatus which make it easier and less costly to produce such a woven fabric. It is still a further object of the present invention to provide an improved woven material useable for composite materials, and to composite materials comprising such woven fabrics.

The objectives are achieved by means of a woven fabric, a method and an apparatus as defined in the appended claims.

According to a first aspect of the invention there is provided a woven fabric comprising tape-like warps and wefts, at least some of which are fibrous tapes, and preferably unidirectional Spread Tows, wherein the warps and wefts interlace, and wherein the warps and/or the wefts are arranged in at least two unidirectional and at least partly overlapping layers, wherein at least one warp/weft of one layer is offset in relation to warps/wefts in the other layer so that the offset warp/weft overlies and covers at least one longitudinal gap between adjacent warps or wefts in the other layer.

Differently stated, the novel woven material composed of tape-like warps and wefts, at least some of which are fibrous tapes, and preferably unidirectional Spread Tows, comprises layers of warps, preferably supplied in mutually offset arrangement, which interlace with wefts that are incorporated individually in either non-overlapping arrangement relative to each other, or in mutually offset arrangement relative to each other.

The woven material of the present invention provides a tape-woven fabric which has no gaps/openings occurring at the areas/sites encircled by intersecting tape-like warps and wefts, is delamination resistant, and has extremely low crimp frequency and/or crimp angle. This is of great importance for woven fabrics comprising fibrous tapes, and in particular for woven fabrics for use in composite materials.

This fabric remains integrated due to the mechanical interconnection by interlacing of warp and weft tapes, and thereby efficiently resists disintegration, separation and delamination. Further, due to the overlapping layers, gaps naturally formed in the fabric are covered, thereby providing a useful fabric. Further, the fabric made using thin and wide Spread Tow fibrous tapes displays extremely low crimp frequency and/or crimp angle. Still further, the fabric is relatively simple and cost-effective to produce.

In one embodiment, all or nearly all warps or wefts of the two respective layers are offset in relation to each other.

In one embodiment, only the weft is provided in the offset, overlapping arrangement, whereas the warps are arranged in one single layer. However, preferably at least the warps are provided in the offset, overlapping arrangement, whereas the wefts may also be arranged in such an offset, overlapping arrangement or be arranged in a single layer. In a preferred embodiment, the warps are provided in said at least two layers, and wherein at least some warps are grouped in units of grouped warps whereby each weft interlaces with the units of such grouped warps. Also, when the warps are provided in such at least two layers, each weft is preferably interlaced with the warps in such a way that at least some warps are grouped in units of grouped warps. The units of grouped warps are preferably interlacing with individual tape-like wefts wherein the individual tape-like wefts are incorporated in a mutually offset and overlapping arrangement relative to each other. Thus, an overlapping tape is hereby preferably provided in at least one, and preferably all, of the unit warps, which extends longitudinally in the warp direction, whereby one of the tapes of the unit grouped warp lies longitudinally over the gap existing between two neighboring warp tapes' adjacent longitudinal edges and covers the gap there between.

Preferably, the fabric has all warps composed of units of two-layered mutually offset and overlapping tapes, and such units of grouped warp tapes interlace with wefts, wherein the wefts are incorporated as individual tape-like wefts in either a non-overlapping arrangement relative to each other, or in mutually offset and overlapping arrangement relative to each other. Hereby, all gaps in the fabric may be covered efficiently.

Further, for some applications it might be preferable to provide a fabric wherein the warps are only individual non-overlapping tapes interlacing with wefts which are incorporated in mutually offset and overlapping arrangement relative to each other. Hereby, all gaps may again be efficiently covered.

In the new and different woven fabric structures obtainable using individual or mutually offset and overlapping arrangement of tape-like warps and/or wefts, at least some of which are fibrous tapes, the gaps/openings at the areas/sites encircled by intersecting layered tape-like warps and wefts on one face of fabric get covered by the layered, preferably fibrous, tape-like warps and/or wefts at the other face. Hereby, a woven material is provided in which even if the adjacent warp tapes', or weft tapes', longitudinal edges are not touching each other, there will be no see-through gaps/openings visible. Naturally such a fabric composed of layered warps and/or layered wefts will be relatively thicker and correspondingly higher in areal weight. Advantageously, such a relatively higher areal weight layered fabric will still be delamination resistant, with extremely low crimp, and in particular having extremely low crimp frequency and/or crimp angle, and hence with flatter surface; aspects which further enhance composite materials' properties.

The new woven fabric incorporating mutually offset and overlapping arrangement of layered, preferably fibrous, tapes in warp and/or weft directions also has the benefit of being delamination resistant and offering flow paths for matrix to impregnate the fabric quickly and uniformly, passage for air for catalytic processes, efficient filtering etc. Thus, the appearance and performance of such a woven fabric stands improved.

The at least one longitudinal gap between adjacent warps or wefts in the other layer preferably has a width of at least 5% of the width of said adjacent warps or wefts, and preferably at least 10%, and most preferably at least 15%. Alternatively or additionally, the width of the gaps is preferably less than the width of the warp tapes. Preferably the gap is less than 50% the width of the warp tape/s considered, and most preferably less than 20% of the width of the warp tapes considered. The above reference to "width" should be understood as being the average width of the warps or wefts, in cases where tapes have either varying/non-uniform widths or when different tape widths are used in the fabric.

The interlacing tapes, preferably of fibrous type, preferably occur above, below and in between said overlapping layers of warp and weft tapes. In other words, the warp and weft tapes occur, in their traverse, on front and back faces of fabric and in between the layers of each other. More specifically, in embodiments where the units of grouped warp tapes are provided in two mutually offset and overlapping layers, it is preferable that the interlacing of the weft tapes occurs in such a way that at least some, and preferably all, wefts run in a path above, below and in between said overlapping warp layers. Hereby, even further improved structural stability is achieved.

Thus, preferably the woven fabric is free from see-through gaps or openings at the areas encircled by intersecting warp tapes and weft tapes.

The fibrous tapes used for producing the said woven material can be of any type of either regular or irregular tape-shaped material and it can be either of one fibrous type or different fibrous types or non-fibrous and fibrous combination types. The fibrous tapes, when used, can be of either spread type or non-spread type. Further, when using spread tapes, the fibres/filaments therein may be distributed either uniformly or randomly, and arranged in either one or more fibre layers, within the tape. At present, it is presumed that fibrous tapes are particularly suitable for composite material applications, whereas non-fibrous and fibrous combination tapes are particularly suitable for e.g. ballistic mitigation applications. However, both types are possible to use in both said applications, as well as in many other possible applications.

In a particularly preferred embodiment, all the tape-like warps and wefts are fibrous tapes.

Further, in a preferred embodiment, the fibrous tapes are Spread Tow Tapes, which have all, or almost all of the constituent carbon fibres/filaments oriented in the tape's longitudinal direction, and hence constitutes unidirectional tapes or UD tapes.

The fibres in the fibrous tapes can be of either one or more of the following types: short/staple length, long length, continuous length (filamentous). Further, such fibrous tapes can have the constituent fibres in either unidirectional or bidirectional or multidirectional orientations. The unidirectional fibres/filaments in the fibrous tapes are preferably arranged in a substantially parallel array. Further, tapes with bidirectional and multidirectional orientations of fibres/filaments therein may be either directly integrated (such as woven, braided, stitched etc.) or indirectly integrated (such as unidirectional tape being either wrapped or adhesively bonded by another fibrous tape or yarn etc.).

Further, the spread and non-spread types of fibrous tapes are preferably partially stabilized or non-stabilized types. Such tapes are relatively flexible, and well suited for weaving. However, the tapes can also be fully stabilized. The fibrous tapes can also be of composite material type, i.e. with fibers embedded in a matrix. Further, the fibrous tapes, including the Spread Tows, are relatively thin and wide whereby their interlacing in the tape-woven fabric generates extremely low crimp, and in particular extremely low crimp frequency and/or crimp angle. Further, preferably most of the fibres/filaments used in obtaining non-stabilized, partially stabilized and fully stabilized may themselves be either wholly coated or partially coated using suitable performance enhancing formulation/s, polymeric/elastomeric binders, etc. to suit application requirements, that is to improve the here-disclosed woven material's performance relating to one or more of mechanical, thermal, chemical, sound, light, electromagnetic use/s etc.

The fibres constituting the fibrous tapes can be either one of, or a combination of at least two of the following: carbon, glass, thermoplastic, ceramic, boron, metal, natural (cotton, silk, hemp, flax, sisal, jute, coconut etc.), and regenerated (rayon, viscose etc.). The non-fibrous tapes, when used, can be composed of either one of or a combination of some of the following: thermoplastic, metal, carbon, fabric, paper.

The preferably fibrous tapes used for producing the woven fabric according to the invention can be of either similar or dissimilar widths, either similar or dissimilar thicknesses, either similar or dissimilar colours, either similar or dissimilar textures/constructions, either similar or dissimilar areal weights, either similar or dissimilar materials.

In one preferred fabric embodiment, at least one of the warps and/or the wefts are fibrous tapes. The fibers/filaments of these tapes are preferably unidirectional. The tapes are preferably non-stabilized or partially stabilized or fully stabilized. The fibrous tapes may also be of spread tow type. Preferably, these fibers are at least one of: carbon fibers (PAN-based, pitch-based, etc.); glass fibers (S-glass, T-glass, A-glass, E-CR glass, C-glass, R-glass, D-glass etc.); thermoplastic fibers (including, for example, poly paraphenylene terephthalamide, and other variants, (generally commercially known as "Kevlar"), p-phenylene terephthalamide, and other variants (generally commercially known as "Twaron"), ultra high molecular weight polyethylene, and other variants (generally commercially known as "Dyneema" and "Spectra" etc.); ceramic fibers; boron fibers; metal fibers (steel, copper, aluminium, silver etc.); natural fibers (cotton, silk, hemp, flax, sisal, jute and coconut etc.); regenerated fibers (rayon, viscose etc.); or combinations thereof. Different grades, tex counts, tenacities or types of such fibers may be chosen according to specific application needs.

In another preferred fabric embodiment, at least one of the warp and/or weft tapes is non-fibrous, and preferably thermoplastic. Preferably for some applications, such thermoplastic tapes are of highly drawn/stretched types having highly linear or extended molecular chains oriented preferably in the longitudinal direction of the tape. The thermoplastic tapes preferable are at least one of: acrylic (PMMA), acrylonitrile butadiene styrene (ABS), polyamide (PA) commercially known as nylon, polylactic acid (PLA), polybenzimidazole (PBI), polycarbonate (PC), polyether sulfone (PES), polyetheretherketone (PEEK), polyetherimide (PEI), polyethylene (PE), polyphenylene oxide (PPO), polyphenylene sulfide (PPS), polypropylene (PP), polystyrene, polyvinylchloride (PVC), polytetrafluoroethylene (PTFE), polyester etc. Different grades or types of such thermoplastic tapes may be chosen according to application needs.

The said woven fabric, comprising one or more types of fibrous tapes or fibrous and non-fibrous tapes indicated above, is composed of either similar or dissimilar types of tapes as warps and wefts. Each of the tapes in the two-layered mutually offset and overlapping warp tapes constituting the woven fabric can be either similar or dissimilar to each other in accordance with the types of tapes indicated above. Likewise each of the tape-like wefts that are incorporated in the mutually offset and overlapping manner relative to the other weft tapes constituting the woven fabric can be either similar or dissimilar to each other in accordance with the types of tapes indicated above.

Such a woven fabric, showing the inherent characteristics of the type/s of tapes used, has no see-through gaps/openings at the areas/sites encircled by intersecting tape-like warps and wefts as the gaps/openings arising from the inherent separation distance between the edges of adjacent tapes gets covered by one of the tapes of the two-layered mutually offset and overlapping tape-like warps, and/or wefts. Such a woven fabric may be used as an individual sheet, or suitably applied or stacked, for improving performance of composite materials, ballistic mitigation materials, etc.

Further, the interlacing of the two-layered mutually offset and overlapping warp tapes with tape-like wefts that are incorporated individually in either non-overlapping manner or in a mutually offset and overlapping manner relative to the other weft tapes improves delamination resistance. Also, such a fabric does not require the adjacent longitudinal edges of two warp tapes to be in contact with each other. Again, this is useful for applications such as composite materials, ballistic mitigation, etc.

Likewise, the tape-like wefts need not be packed close to each other to have their longitudinal edges in contact with each other. Because the warp and weft tapes are not required to be packed closely to minimize the size of the previously inevitable see-through gaps in the fabric, there are at least two advantages. First, it is not necessary for the fibrous tapes to have well-defined or sharp straight edges, and second, the production of the fabric can be quickened. Through both these aspects savings in cost of materials and production can be achieved. Hereby, a novel woven fabric is made available economically wherein tapes in either a two-layered mutually offset and overlapping arrangement or as single (i.e. non-overlapping arrangement) are provided as warps and such warp tapes interlace with tape-like wefts which are incorporated individually in either non-overlapping manner or in a mutually offset and overlapping manner relative to other weft tapes. The resulting woven fabric, which has no see-through gaps/openings, is also delamination resistant and has extremely low crimp, and in particular extremely low crimp frequency and/or crimp angle.

The woven fabric preferably has an areal weight in the range 40-4000 grams/sq, m, and more preferably in the range 100-2000 grams/sq·m, and most preferably in the range of 200-1000 grams/sq, m. Such fabric are particularly suitable for use in composite materials.

Further, the woven fabric preferably has a fabric thickness in the range 0.02-5 mm, and more preferably in the range 0.05-2 mm, and most preferably in the range of 0.1-1 mm. Such fabric are particularly suitable for use in composite materials.

The width of the warp and weft tapes, and in particular fibrous tapes, are preferably in the range of 5-100 mm, and more preferably in the range of 10-70 mm, and even more preferably in the range of 10-60 mm, and most preferably in the range of 20-50 mm.

The fibrous tapes are preferably made by spreading fibrous tows having a count in the range of 1 k to 60 k, where "k" refers to the number of fibers in thousands in a tow. More preferably, the fibrous tapes are preferably made by spreading fibrous tows having a count in the range of 6-48 k, and most preferably in the range of 12-24 k. Count may also be expressed as mass of fibers in the tape in grams per 1000 meter of length, commonly referred to as Tex. The fibrous tapes preferably has a count in the range of 50-5000 Tex, and more preferably in the range of 100-3000 Tex, and most preferably in the range of 1000-2000 Tex.

The woven fabric of the present invention has a very low crimp, Crimp can be measured by crimp frequency, which is e.g. determinable in accordance with the standard ASTM D3937-12. The woven fabric preferably has a crimp frequency in the range of 10/m to 75/m, and more preferably in the range of 20/m to 50/m, and most preferably in the range of 15/m to 40/m.

Another well-known way to determine crimp is to measure a crimp angle, where the crimp angle is the maximum acute angle of a single weaving tape (or yarn) direction measured from a plane parallel to the surface of the fabric. The crimp angle of the woven fabric of the present invention is preferably in the range of 0° to 10°, and more preferably in the range 0° to 5°, and more preferably in the range 0° to 3°, The fibrous tapes are preferably unidirectional, i.e. where all or almost all of the fibers are arranged in parallel direction, and oriented in the length direction of the tapes. Preferably, the unidirectional tapes have at least 90% of the fibers arranged in such a parallel orientation along the longitudinal direction of the tapes, and more preferably at least 95%, and most preferably at least 99%.

According to another aspect of the invention, there is provided a method for producing a woven fabric comprising the steps:

providing, and preferably feeding, a set of fibrous tape-like warps;

creating a shed in warps;

inserting fibrous tape-like wefts in the created shed;

wherein the steps are performed to interlace warp tapes and weft tapes, and wherein the step of forming a shed involves usage of at least some units of grouped warp tapes, each of such units of grouped warp tapes having at least two tapes that are mutually offset and overlapping, the tapes extending longitudinally and unidirectionally, whereby at least one of the warp tapes from one layer overlies and covers the gap existing between adjacent longitudinal edges of warp tapes of the other layer.

By means of this aspect, similar advantages and specific features and embodiments as discussed above in relation to the first aspect are obtainable.

The method may further comprise the step of advancing the produced fabric, wherein the fabric is advanced by a distance whereby the wefts are enabled to be incorporated in the fabric in either a non-overlapping manner or in a mutually offset and overlapping manner relative to other weft tapes.

Also, the step for creating a shed preferably enables a shed to be created over a previously laid weft to incorporate the new weft in a mutually offset and overlapping manner relative to the previously laid weft.

Further, the step of inserting fibrous tape-like wefts in the created shed is further preferably followed or preceded by at least one, and preferably all, the sub-steps:

cutting tape-like wefts;

positioning laid wefts at fabric-fell; and winding up paid-out or advanced fabric into a roll.

According to still another aspect of the invention, there is provided an apparatus for producing a woven fabric comprising:

a warp holding arrangement providing, and preferably feeding, fibrous tape-like warps;

a shed forming device for creating sheds in the warps; and a weft inserting device for insertion of fibrous tape-like wefts in the created shed;

wherein the said shed forming device and weft inserting device perform interlacing of warp tapes and weft tapes, and wherein the shed forming device is arranged to create a shed involving usage of at least some units of grouped warp tapes, each of such units of grouped warp tapes having at least two tapes that are mutually offset and overlapping, the tapes extending longitudinally and unidirectionally, and at least one of the warp tapes from one layer overlies longitudinally covering the gap existing between the adjacent longitudinal edges of the warp tapes of the other layer. By means of this aspect, similar advantages and specific features and embodiments as discussed above in relation to the first aspect are obtainable.

The apparatus preferably further includes means for advancing the produced fabric, whereby the shed forming device preferably enables a shed to be created over a previously laid weft to incorporate the new weft in a mutually offset and overlapping manner relative to the previously laid weft.

Means for advancing the produced fabric may also be provided, and preferably this means advances the fabric by a distance whereby the wefts are enabled to be incorporated in the fabric in either a non-overlapping manner or in a mutually offset and overlapping manner relative to other weft tapes.

Still further, one or several of the following parts may be provided in the production apparatus:

a cutter for cutting fibrous tape-like wefts into adequate lengths;

a positioner for positioning laid fibrous wefts at fabric-fell; and a winder for winding-up produced fabric onto a roll.

Preferably, the woven fabric comprising fibrous tape-like warps and wefts is produced by employing the new technique and apparatus wherein preferably tapes in a two-layered mutually offset and overlapping arrangement are supplied as units of grouped warps and the provided tape-like wefts are incorporated individually in either non-overlapping manner or in a mutually offset and overlapping manner relative to other weft tapes. Through such a method and apparatus the weft tapes are laid in the shed to commonly interlace and connect with select warp tapes of the different overlapping layers in a desired manner and produce the said novel gap-free and delamination resistant woven fabric. Alternatively, the method and the apparatus can be also employed to produce a gap-free and delamination resistant woven material using a set of single-layered tape-like warps and interlacing them with weft tapes that are incorporated in a mutually offset and over-lapping manner relative to other weft tapes. The number of interconnections in a given area between the warps and wefts is dependent on performance requirements and it is a function of the weave pattern, and the thickness and widths of the tape-like warps and wefts used.

These and other features and advantages of the present invention will be further clarified in the following in reference to the embodiments described hereinafter.

BRIEF DESCRIPTION OF DRAWINGS

For exemplifying purposes, the invention will be described in closer detail in the following with reference to embodiments thereof illustrated in the attached drawings, wherein.

DESCRIPTION OF PREFERRED EMBODIMENTS

Figure 1A:
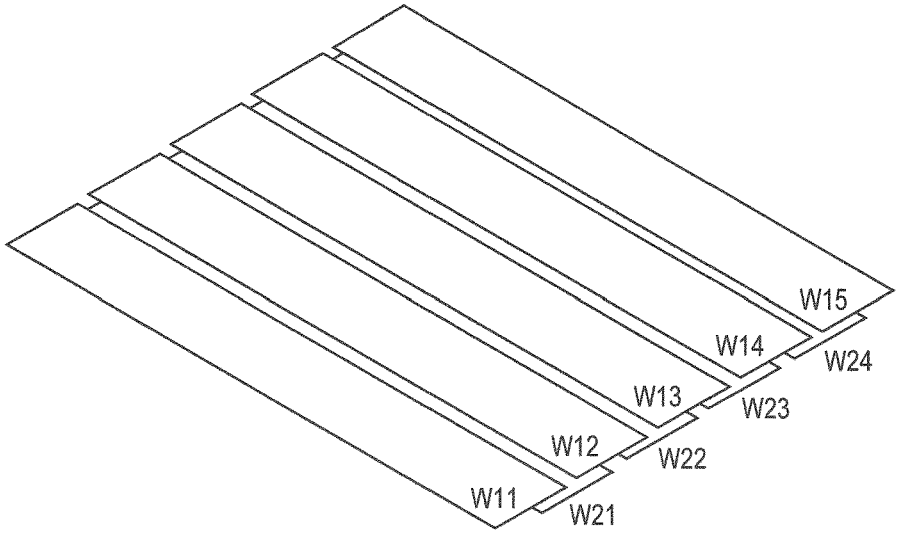
FIGS. 1*a* and 1*b* show the warp tapes arranged in a two unidirectional mutually offset and at least partly overlapping layers in accordance with an intermediate step of forming a woven fabric of an embodiment of the present invention.

In the following detailed description, preferred embodiments of the present invention will be described. However, it is to be understood that features of the different embodiments are exchangeable between the embodiments and may be combined in different ways, unless anything else is specifically indicated. It may also be noted that, for the sake of clarity, the dimensions of certain components in the drawings may differ from the corresponding dimensions in real-life implementations of the invention. Even though in the following description, numerous illustrated specific details are set forth to provide a more thorough understanding of the present invention, it will be apparent to one skilled in the art that the present invention may be practiced without these specific details. In other instances, well known constructions or functions are not described in detail, so as not to obscure the present invention.

Figure 1B:
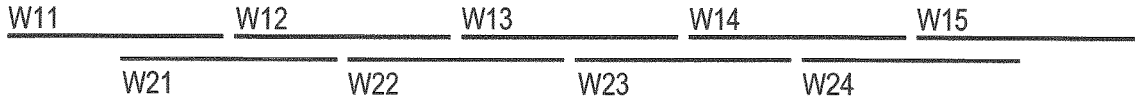

The novel woven fabric, according to one embodiment, may be realized by supplying fibrous warp tapes preferably at least in two unidirectional mutually offset and at least partly overlapping layers arrangement as shown in FIGS. 1*a* and 1*b*. The two layers of tapes comprise the first set of tapes W11-W15 and the second set of tapes W21-W24. As shown in FIGS. 1*a* and 1*b*, the two sets of warps are supplied in a mutually offset manner such that the gap between the adjacent longitudinal edges of two tapes of the first set are covered by a longitudinal mid-part of a tape of the other set, and vice-versa. For example, the gap between the adjacent longitudinal edges of the tapes W11 and W12 is covered by a longitudinal mid-part of tape W21. FIG. 1*b* represents the end view of the mutually offset arrangement of the tapes indicated in FIG. 1*a*.

The mutually offset and overlapping layers of warp tapes extend in parallel longitudinal directions, with gaps formed there between also extending longitudinally. The warp tapes may be arranged very close to each other, thereby forming narrow longitudinal gaps, or be more displaced from each other, thereby forming more pronounced longitudinal gaps. The gaps formed between the different warp tapes may be of the same or varying width. However, preferably, the width of the gaps is less than the width of the warp tape. Preferably the gap is less than 50% the width of the warp tape/s, and most preferably less than 20% of the width of the warp tapes.

As can be observed now, by the mutually offset and overlapping arrangement of the warp tapes, and taking into consideration the width of the individual warp tapes used and the width of the longitudinal gaps between adjacent warp tapes, the warp tape/s of one layer can lie over at least one longitudinal gap between adjacent warps in the other layer. Preferably, all the warp tapes are arranged in this way to cover all the longitudinal gaps.

In the illustrative embodiment of FIG. 1, the mutual offset between overlapping warp tapes (all of which are indicated to be of the same width), for example W11 and W21, W12 and W22 etc., is less than 50% the width of the warp tapes. By such offset the longitudinal gaps between warp tapes, for example W21 and W22, W22 and W23 are covered centrally by the respective tapes W11 and W12. However, other offset distances are also feasible. For example, the offset may be as low as 5-20%, particularly when the gaps are required to be relatively narrow.

It may be noted that because the two layers of fibrous tape-like warps are supplied in a mutually offset arrangement, the number of tape-like warps in a first set could be greater by one than the number of tape-like warps in the other set. However, one may also use equal number of tapes in both layers in the mutually offset supply of the tape-like warps. In both these instances, if required, the non-doubled longitudinal part of one or both the outermost warp tapes can be made double-layered through use of relatively narrower tapes, for example to achieve over all greater uniformity in woven material's thickness.

Figure 2A:
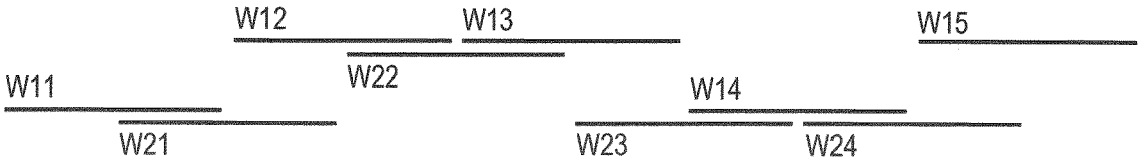
FIGS. 2*a*-2*b* show displacement of select tape-like warps in the two layers of FIG. 1 to create a shed, as a further step in forming the woven fabric.
Figure 2B:
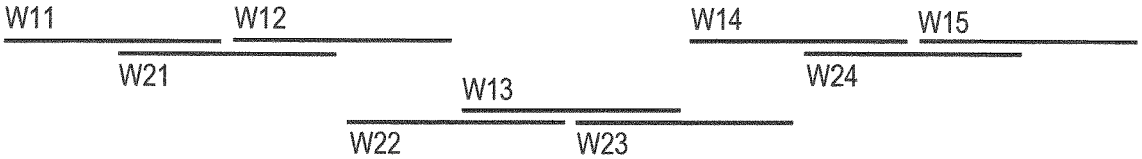

The supplied mutually offset fibrous tape-like warps are subjected to shedding using a suitable method and means. Depending on the weave pattern to be created, tape-like warps, at least one each from both the layers, for example (W11, W21) and (W12, W13, W22) shown in FIG. 2*a*, are selected to function as a unit of grouped warp tapes for crossed-separation to create the shed. Each of such units of grouped warp tapes, as also an individual warp tape, involved in shedding are henceforth referred to here as unit warp. It may be noted that the tapes selected in one unit warp during a particular shed formation could be different from that in the subsequent shed formation. Thus, while (W11, W21), (W12, W13, W22), (W14, W23, W24), (W15) in FIG. 2*a* function as selected units of warps for being suitably displaced to create a shed, for the subsequent shed formation the warp tapes selected in units of warps would comprise different tapes, for example (W11, W12, W21), (W13, W22, W23), (W14, W15, W24), as shown in FIG. 2*b*. As can be noticed, the number of tapes in a given unit warp can be different from that of another unit warp. In the illustrative example of FIG. 2*a*, the shed is formed by units of warps in each of which are different numbers of tapes—unit of grouped warp tapes W11 and W21 (two tapes); unit of grouped warp tapes W12, W22 and W13 (three tapes); unit of grouped warp tapes W23, W14 and W24 (three tapes); and unit of warp tape W15 (one or single tape). Differing numbers of warp tapes are selectable in this weaving method, as desired, from the two layers to form units of grouped warp tapes for shedding. The step for shedding thus involves usage of at least some units of grouped warp tapes each of which may be composed of either same or differing numbers of tapes in accordance with the weave pattern being created.

Figure 3:
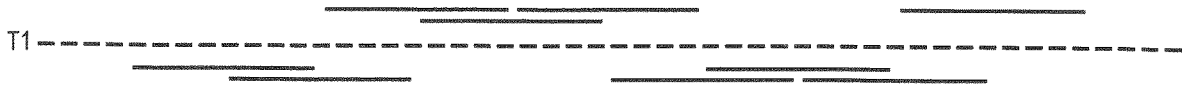
FIG. 3 shows the weft inserted in the created shed of FIG. 2*a*.

A fibrous tape-like weft T1, shown in FIG. 3, is subsequently suitably inserted into the created shed, preferably in a flat condition, using any of the known weft inserting methods and means. The tape-like wefts are laid individually but are incorporated in the fabric in either non-overlapping manner or in a mutually offset and overlapping manner relative to other weft tapes. Whereas the non-overlapping manner of weft incorporation is achieved by setting the fabric take-up to advance the fabric by a length that is at least the width of the weft tape inserted, the mutually offset and over-lapping manner of weft incorporation is achieved by setting the fabric take-up to advance the fabric by a length that is less than the width of the weft tape inserted. For example, the length of fabric advancement when incorporating wefts in a non-overlapping manner can be 50% more than the width of the inserted weft, and when wefts are to be incorporated in a mutually offset and overlapping manner it could be even less than 50% of the width of the inserted/laid weft. A "less-than-the-width-of-weft" distance of fabric advancement for incorporating wefts tapes in a mutually offset and overlapping manner is possible because the weaving method uniquely allows creation of a shed with units of grouped warp tapes whereby the subsequent weft tape can be incorporated over an already inserted weft tape as the previously inserted weft tape will exist in a plane under the newly created shed.

Figure 4A:
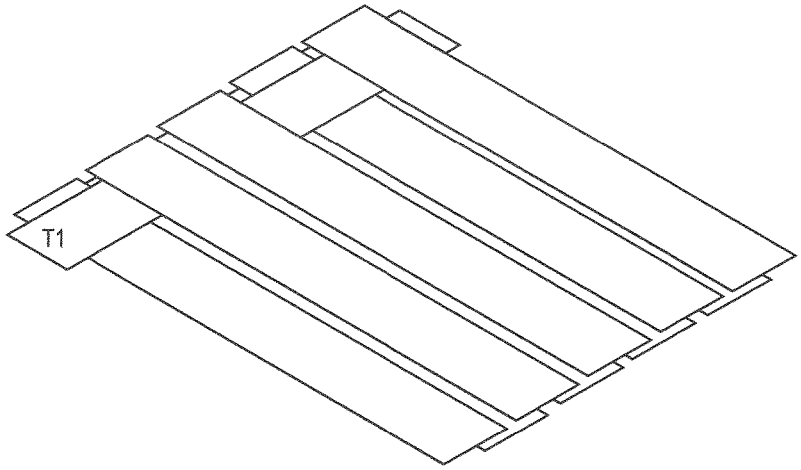
FIGS. 4*a*-4*c* show an exemplary embodiment of the production of a woven fabric by interlacing of the two-layered mutually offset and overlapping fibrous tape-like warps with individual non-overlapping fibrous tape-like wefts in accordance with an embodiment of the invention, and the produced fabric's cross-sectional structure.
Figure 4B:
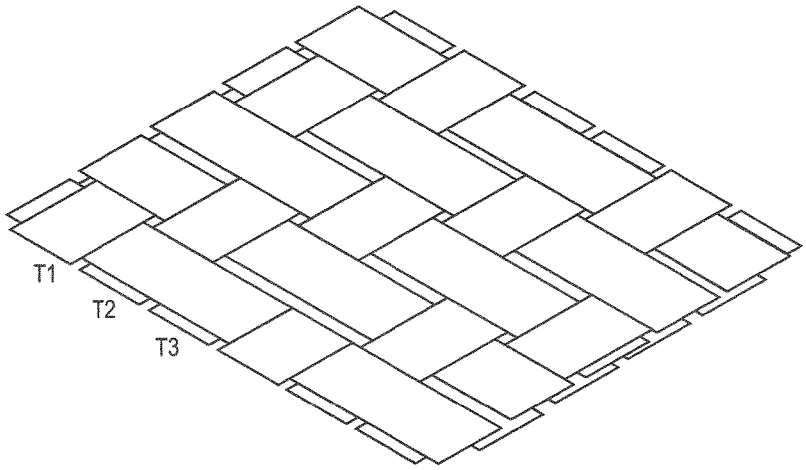

As can be inferred now, a woven fabric is producible wherein the two-layered mutually offset and overlapping fibrous tape-like warps (i.e. units of grouped warps) and the individual fibrous tape-like weft T1 interlace as shown in FIG. 4*a* and create the gap-free woven fabric according to the present invention. FIG. 4*b* shows a woven fabric wherein individual fibrous tape-like wefts T1-T3 are incorporated in the non-overlapping manner. Subsequent weft tapes are incorporated in a corresponding repeating manner to continuously produce a large fabric. Although these weft tapes occur successively (i.e. without being mutually offset and overlapping each other) in the usual way, there is still no see-through gap created in the fabric due to the presence of overlapping warp tapes.

Figure 4C:
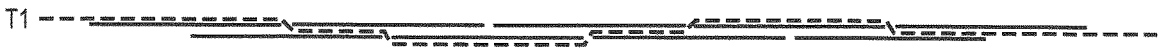

In FIG. 4*c* is represented the path of a fibrous tape-like weft, for example that of T1 (shown in FIGS. 4*a* and *b*), when interlacing with different units of grouped warp tapes. The illustrative example in FIG. 4*c* shows a weft running first, when seen from left to right, above the warps, then between the warp layers, then below the warps, then again between the warp layers, then above the warps and finally between the warp layers. Preferably each subsequent weft also runs similarly in different paths and thereby forming a strong mechanical interconnection to resist delamination of warp-weft layers in the fabric.

After insertion of the fibrous tape-like weft through the shed is completed, subsequent operations relating to beating-up/positioning of the individual tape-like wefts towards the fabric-fell position, taking-up/advancing forward the produced fabric as discussed in the foregoing, and winding-up the paid-out fabric onto a roll, may be performed using known methods and means to complete a full weaving cycle. New cycles may then be performed to produce a larger fabric continuously.

Thus, subsequent to the optional weft beating-up, fabric taking-up, fabric winding-up etc., the next weaving cycle commences wherein the required select units of grouped warp tapes are displaced to create the following new shed into which the new tape-like weft is inserted. These various weaving operations are performed in required order cyclically to produce the novel gap-free and delamination resistant woven fabric in a continuous manner.

As can be inferred now, a woven fabric is produced wherein the gaps/openings at the areas/sites encircled by intersecting fibrous tape-like warps and wefts are, at least to some extent and preferably fully, get covered by the tapes of the two-layered mutually offset and overlapping tape-like warps. As a result, the gaps/openings in the fabric become invisible. Also, the warp-weft layers in the fabric are interconnected to resist delamination. Further, the relatively thin and wide fibrous tapes have extremely low crimp frequency and/or crimp angle.

Figure 5:
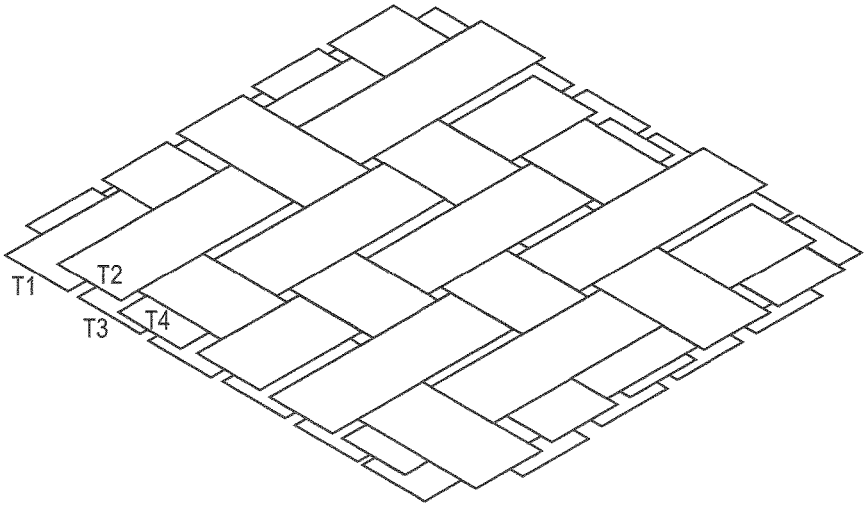
FIG. 5 shows one example of the novel woven fabric wherein two-layered mutually offset and overlapping fibrous tape-like warps interlace with fibrous tape-like wefts that are incorporated individually in a mutually offset and overlapping manner relative to other weft tapes.
Figure 6A:
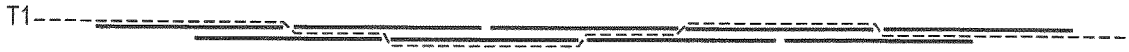
FIGS. 6*a*-6*d* show an example of a sequence of some steps of incorporating different wefts in the woven fabric of a weave pattern, in accordance with another embodiment of the present invention.
Figure 6B:
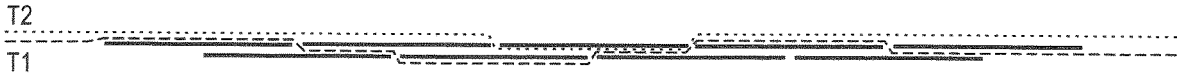
Figure 6C:
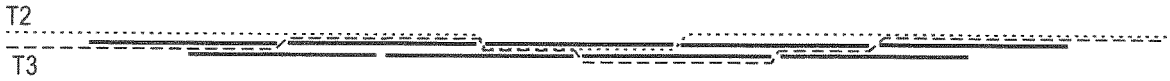
Figure 6D:
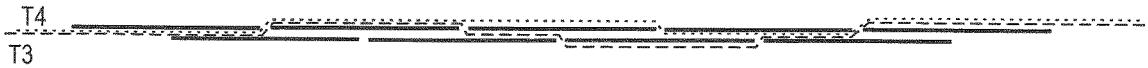

Following the outlined weaving procedures, one example of a woven fabric composed of mutually offset and overlapping fibrous tape-like warps and tape-like wefts T1-T4 that are incorporated individually in a mutually offset and overlapping manner relative to other weft tapes is exemplified in FIG. 5. By incorporating both the tape-like warps and wefts in a mutually offset and overlapping manner, even if the spacing between the longitudinal edges of the adjacent tapes in the warp and weft directions is more than 50% of the width of the tapes used in a given direction, there will be no see-through gaps. FIGS. 6*a*-6*d* represent the stepwise different paths of mutually offset and overlapping wefts T1-T4 incorporated in the woven fabric corresponding to that shown in FIG. 5. FIG. 6*a* illustrates the path of a first weft T1. FIG. 6*b* illustrates the paths of wefts T1 and T2 in a cross-section where T1 and T2 are incorporated in mutually offset and overlapping configuration. FIG. 6*c* illustrates the paths of wefts T2 and T3 in a cross-section where T2 and T3 are incorporated in mutually offset and overlapping configuration. FIG. 6*d* illustrates the paths of wefts T3 and T4 in a cross-section where T3 and T4 are incorporated in mutually offset and overlapping configuration.

It may be pointed out here that the described supply arrangement of mutually offset and overlapping tape-like warps is not limited to only two tape layers as illustrated herein. Additional one or more layers of tapes can be also supplied suitably in the indicated offset arrangement, and the weaving operations similarly performed as described, to obtain a relatively thicker, gap-free and unified delamination resistant woven fabric. Here again, individual tape-like wefts, in either non-overlapping manner or in a mutually offset and overlapping manner relative to other weft tapes, can be used.

It may be noted that by weaving of units of grouped warp tapes with tape-like wefts in a mutually offset and overlapping manner relative to other weft tapes either balanced or unbalanced woven fabrics can be obtained according to the performance requirements by varying desired parameters such as tape widths, tape thickness, spacing between warp tapes, spacing between weft tapes, weave patterns, take-up rates etc. Needless to state, a person skilled in the art will also understand now that a woven fabric comprising single-layered, or non-overlapping, tape-like warps can be used and interlaced with tape-like wefts which are incorporated in a mutually offset and overlapping manner relative to other weft tapes to produce a fabric that is also free of see-through gaps and delamination resistant. It will be also apparent now that through use of relatively thinner but doubled warp and/or weft tapes, fabrics which are either thicker or heavier in areal weight are directly producible. Likewise, it is also possible to obtain a woven fabric comprising non-fibrous and fibrous tapes.

Further, the described novel tape-woven fabric could be used, depending on application and/or product requirements, in any required orientation. For example, a cut-sheet oriented 45° relative to the warp (or weft) direction could be used as a bias material. Or, a cut-sheet could be draped in a way to occur in either two mutually perpendicular planes or three mutually perpendicular planes. Still further, it could be used to drape in double curvature. Such cut-sheets could be also stacked in relatively different orientations to create a multidirectional material. Still further, such cut-sheets could be combined with other existing types of fabrics to benefit from the advantageous features of the tape-woven fabric according to the described invention.

Further, as already mentioned above, the longitudinal gaps between edges of adjacent tapes may have either the same or different widths, and may be relatively large or relatively small. Further, the tapes used in the fabric may have either a relatively large or a relatively small width. A fabric may also be produced using tapes of different widths. For example, it is possible to use one width for the tapes forming the warps, and a different width for the tapes forming the wefts. It is also possible to use warps and/or wefts having different widths. Still further, the tapes may be of the same or different materials. It is also possible, as will be appreciated by the skilled addressee, to provide many different weave patterns.

Such and other obvious modifications must be considered to be within the scope of the present invention, as defined by the appended claims. It should be noted that the above-mentioned embodiments illustrate rather than limit the invention, and that those skilled in the art will be able to design many alternative embodiments without departing from the spirit and scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements. Further, a single unit may perform the functions of several means recited in the claims.

The invention claimed is:

1. A woven fabric comprising warps and wefts of tapes, wherein all of the warps and wefts are fibrous tapes, wherein the warps and wefts interlace, and wherein both the warps and the wefts are arranged in at least two unidirectional and at least partly overlapping layers, wherein at least one warp and at least one weft of one layer is offset in relation to warps and wefts in the other layer so that each of the offset warp and weft overlies and covers at least one longitudinal gap between adjacent warps or wefts in the other layer, wherein all the tapes have a thickness lower than their widths, and wherein the mutually offset and partly overlapping warps and wefts of the at least two layers mutually interlace to form a delamination resistant woven fabric.

2. The woven fabric of claim 1, wherein all warps or wefts of the two respective layers are offset in relation to each other.

3. The woven fabric of claim 1, wherein at least some warps in the at least two layers are grouped in units of grouped warps comprising warps from each of the said at least two layers, whereby each weft interlaces with the units of grouped warps.

4. The woven fabric of claim 3, wherein units of grouped warps are interlacing with individual wefts wherein the individual wefts are incorporated in a mutually offset and overlapping arrangement relative to each other.

5. The woven fabric of claim 1, wherein the fabric is free from see-through gaps or openings at areas encircled by intersecting warp tapes and weft tapes.

6. The woven fabric of claim 1, wherein the fibrous tapes are tapes in which the fibers are substantially unidirectional in orientation.

7. The woven fabric of claim 1, wherein said interlacing warp and weft tapes occurs mutually above, below and in between said overlapping layers.

8. The woven fabric of claim 1, wherein the interlacing of the weft occurs in such a way that at least some weft(s) runs in a path above, below and in between said overlapping warp layers.

9. The woven fabric of claim 1, wherein it has an areal weight in the range 40-4000 grams/sq·m.

10. The woven fabric of claim 1, wherein it has a fabric thickness in the range 0.02-5 mm.

11. The woven fabric of claim 1, wherein the width of the warp and weft tapes are in the range of 5-100 mm.

12. The woven fabric of claim 1, wherein the fibrous tapes each comprise a number of fibers/filaments in the range of 1,000 to 60,000.

13. The woven material of claim 1, wherein the fibrous tapes have a linear density of fibers in the tape in grams per 1000 meter of length in the range of 50-5000 Tex.

14. The woven fabric of claim 1, wherein it has a crimp frequency in the range of 10/m to 75/m.

15. The woven fabric of claim 1, wherein it has a crimp angle in the range of 0° to 10°.

16. The woven fabric of claim 1, wherein the woven fabric is a reinforcement for use in a composite material.

17. A woven fabric comprising warps and wefts of tapes, wherein all of the warps and wefts are fibrous tapes, wherein the warps and wefts interlace, and wherein the warps are arranged in at least two unidirectional and at least partly overlapping layers, wherein at least one warp of one layer is offset in relation to warps in the other layer so that the offset warp overlies and covers at least one longitudinal gap between adjacent warps in the other layer, wherein at least some warps in these layers are grouped in units of grouped warps comprising warps from each of said at least two layers, whereby each weft interlaces with the units of grouped warps, and wherein units of grouped warps are interlacing with individual wefts, wherein the individual wefts are incorporated in a mutually offset and overlapping arrangement relative to each other, and wherein all the tapes have a thickness lower than their widths.

18. The woven fabric of claim 1, wherein the tapes have a width in the range of 10-70 mm and a thickness in the range of 0.05-2 mm.

19. The woven fabric of claim 1, wherein the adjacent warps and wefts in at least one of said layers are separated by longitudinal gaps having a width in the range of 10-50% of the width of the warps and wefts.

20. The woven fabric of claim 1, wherein all warps and wefts are fibrous tapes having fibers of the same type, and all having similar widths and thicknesses.

* * * * *